US011510454B2

(12) United States Patent
Cima et al.

(10) Patent No.: US 11,510,454 B2
(45) Date of Patent: Nov. 29, 2022

(54) LOCKING AND UNLOCKING DEVICE FOR A SPORTS BOOT

(71) Applicant: ROSSIGNOL LANGE S.R.L., Treviso (IT)

(72) Inventors: Paolo Cima, Volpago del Montello (IT); Danilo Frada, Montebelluna (IT); Massimo Poloni, Montebelluna (IT); Tiziano Posato, Maser (IT)

(73) Assignee: ROSSIGNOL LANGE S.R.L., Treviso (IT)

( * ) Notice: Subject to any disclaimer, the term of this patent is extended or adjusted under 35 U.S.C. 154(b) by 0 days.

(21) Appl. No.: 16/725,026

(22) Filed: Dec. 23, 2019

(65) Prior Publication Data

US 2020/0205509 A1 Jul. 2, 2020

(30) Foreign Application Priority Data

Dec. 27, 2018 (EP) ..... 18425106

(51) Int. Cl.
*A43B 5/04* (2006.01)

(52) U.S. Cl.
CPC ..... *A43B 5/0474* (2013.01); *A43B 5/0456* (2013.01)

(58) Field of Classification Search
CPC ... A43B 5/0474; A43B 5/0456; A43B 5/0439; A43B 5/0454; A43B 5/047; A43B 5/0478; A42C 11/142; A42C 11/1453; A42C 11/1406
USPC ..... 36/50.5, 118.9
See application file for complete search history.

(56) References Cited

U.S. PATENT DOCUMENTS 4,095,356 A * 6/1978 Robran ..... A43B 5/0458 36/105
4,587,747 A * 5/1986 Courvoisier ..... A43B 11/00 36/118.9
4,669,202 A * 6/1987 Ottieri ..... A43B 1/0018 36/118.5

(Continued)

FOREIGN PATENT DOCUMENTS

EP 161441 A1 * 11/1985 ..... A43B 5/0452
EP 0514762 A2 * 11/1992 ..... A43B 5/0456

(Continued)

OTHER PUBLICATIONS

European Search Report and Written Opinion dated Jun. 13, 2019 issued in counterpart application No. EP18425106; w/ English machine translation (17 pages).

*Primary Examiner* — Alissa L Hoey
*Assistant Examiner* — Patrick J. Lynch
(74) *Attorney, Agent, or Firm* — WHDA, LLP

(57) ABSTRACT

A locking and unlocking device includes an actuation element and a lock and a rear deflector. The actuation element is mobile between a first position and a second position, controlling the position of the lock and the position of the rear deflector such that in the first position, the lock occupies a locking position to block an upper cuff in rotation relative to a shell base, and the rear deflector occupies a low position to close a cut-out at the rear of a shell base; and in the second position, the lock occupies an unlocking position to release the rotation of an upper cuff relative to a shell base, and the rear deflector occupies a high position to open up at least partly a cut-out at the rear of a shell base, in order to increase the amplitude of flexure of a lower leg in a sports boot.

17 Claims, 6 Drawing Sheets

(56) References Cited

U.S. PATENT DOCUMENTS

| | | | | |
|---|---|---|---|---|
| 5,031,341 | A * | 7/1991 | Paris | A43B 5/048 36/118.8 |
| 5,065,533 | A * | 11/1991 | Paris | A43B 5/0474 36/118.1 |
| 2012/0198725 | A1 | 8/2012 | Sartor | |
| 2014/0013629 | A1* | 1/2014 | Haugen | A43B 5/0496 36/117.1 |
| 2016/0324252 | A1* | 11/2016 | Viniero | A43B 5/0496 |
| 2016/0345658 | A1 | 12/2016 | Grandin et al. | |
| 2018/0070672 | A1 | 3/2018 | Parisotto | |

FOREIGN PATENT DOCUMENTS

| | | | | |
|---|---|---|---|---|
| EP | 572373 | A1 * | 12/1993 | A43C 11/14 |
| EP | 2 486 817 | A1 | 8/2012 | |
| EP | 3 097 807 | A1 | 11/2016 | |
| EP | 3 292 778 | A1 | 3/2018 | |
| FR | 2 656 989 | A1 | 7/1991 | |
| FR | 3015190 | B1 * | 7/2016 | A43B 5/0452 |

* cited by examiner

LOCKING AND UNLOCKING DEVICE FOR A SPORTS BOOT

The application claims priority of European patent application No. 18425106.4 filed Dec. 27, 2018, the content of which is hereby incorporated by reference herein in its entirety.

The invention relates to a locking and unlocking device in order to form an interface between a shell base and an upper cuff of a sports boot, in particular of a ski boot, the upper cuff being articulated in rotation around the shell base. The invention also concerns a sports boot, in particular a ski boot comprising a locking and unlocking device of this type.

For the practice of skiing, sports boots are known comprising a shell base and an upper cuff articulated in rotation around the shell base. The shell base envelops the foot below the ankle, whereas the upper cuff envelops the bottom of the leg above the ankle. The articulation between the shell base and the upper cuff permits easy insertion of the foot in the boot, as well as natural walking, since the articulation of the ankle is not blocked. When the boot is being used in descent for the practice of downhill skiing, the articulation between the shell base and the upper cuff must be blocked in order to control the skis efficiently.

In order to block or release the articulation between the shell base and the upper cuff, use is known of a locking and unlocking device also known as a "ski-walk" device. These devices comprise a lever which can be actuated by hand, and make it possible to choose between two configurations of the boot. The first, so-called "ski" configuration blocks the articulation between the upper cuff and the shell base. The second, so-called "walk" configuration releases the articulation between the upper cuff and the shell base.

However, the locking and unlocking devices known in the prior art comprise some or all of the following disadvantages:

- they are complex to produce;
- they have limited reliability, i.e. they can break and/or become worn easily, or go at the wrong time from one configuration to the other;
- they are heavy and/or bulky;
- they are difficult to manipulate;
- they do not make it possible to obtain sufficient amplitude of movement to obtain satisfactory walking comfort.

The objective of the invention is to provide a locking and unlocking device which eliminates the above disadvantages, and improves the locking and unlocking devices known in the prior art. In particular, the invention makes it possible to provide locking and unlocking devices which are simple to produce, reliable, robust, light, compact, and easy to manipulate. Another objective of the invention is to make it possible to obtain a walking configuration which permits sufficient amplitude of movement for the comfort of the user.

For this purpose, the invention is based on a locking and unlocking device in order to form an interface between a shell base and an upper cuff of a sports boot, wherein the upper cuff is articulated in rotation around the shell base, characterised in that the locking and unlocking device comprises an actuation element, a lock and a rear deflector, the said actuation element being mobile between a first position and a second position, controlling the position of the lock and the position of the rear deflector such that:

- in the first position of the said actuation element, the lock occupies a locking position in which the lock can block an upper cuff in rotation relative to a shell base, and the rear deflector occupies a low position in which it can close a cut-out at the rear of a shell base;
- in the second position of the said actuation element, the lock occupies an unlocking position in which the lock can release the rotation of an upper cuff relative to a shell base, and the rear deflector occupies a high position in which it can open up at least partly a cut-out at the rear of a shell base, in order to increase the amplitude of flexure of a lower leg in a sports boot.

The invention also relates to a sports boot as such, in particular a ski boot, comprising a locking and unlocking device of this type.

The invention is defined more precisely by the points below.

1. Locking and unlocking device in order to form an interface between a shell base and an upper cuff of a sports boot, wherein the upper cuff is articulated in rotation around the shell base, characterised in that the locking and unlocking device including: an actuation element, a lock and a rear deflector, the said actuation element being mobile between a first position and a second position, controlling the position of the lock and the position of the rear deflector such that:
   - in the first position of the said actuation element, the lock occupies a locking position in which the lock can block an upper cuff in rotation relative to a shell base, and the rear deflector occupies a low position in which it can close a cut-out at the rear of a shell base;
   - in the second position of the said actuation element, the lock occupies an unlocking position in which the lock can release the rotation of an upper cuff relative to a shell base, and the rear deflector occupies a high position in which it can open up at least partly a cut-out at the rear of a shell base, in order to increase the amplitude of flexure of a lower leg in a sports boot.

2. Locking and unlocking device according to the preceding point, characterised in that the rear deflector is distinct from the lock, and/or is mobile vertically, such as to be fitted substantially according to vertical sliding relative to an upper cuff.

3. Locking and unlocking device according to one of the preceding points, characterised in that the locking and unlocking device comprises at least one connection element, such as a connection arm, connecting the actuation element to the rear deflector.

4. Locking and unlocking device according to one of the preceding points, characterised in that the actuation element is a lever and/or in that the lock is a rocker.

5. Locking and unlocking device according to the preceding points, characterised in that the locking and unlocking device includes:
   - a rocker which is mobile between:
     - a locking position in which the rocker can block the rotation of an upper cuff relative to a shell base; and
     - an unlocking position in which the rocker can release the rotation of an upper cuff relative to a shell base:
   - a lever which is mobile between a first position and a second position; and
   - a spring, in particular a torsion spring, comprising a first part which is connected to the rocker and a second part which is connected to the lever;

the rocker, the lever and the torsion spring being designed such that:
   - when the lever is in its first position, the rocker is in the locking position;
   - when the lever is in its second position, the rocker is in the unlocking position;
   - the position of locking and the position of unlocking of the rocker are maintained stable under the effect of the spring;

a displacement of the rocker is driven by a displacement of the lever by means of the spring.

6. Locking and unlocking device according to the preceding point, characterised in that the spring is a torsion spring which includes a set of coils arranged around an axis which is designed to be oriented parallel to a transverse axis (Y) of a sports boot, and/or in that the torsion spring is of the "kickover" type.

7. Locking and unlocking device according to the preceding point, characterised in that the actuation element is a rocker which includes:

a first end equipped with a hooking means which can co-operate with a shell base when the rocker is in the locking position;

a second end equipped with a means for connection to the torsion spring;

the rocker being mobile in rotation around a first rotational shaft positioned between the first end and the second end.

8. Locking and unlocking device according to one of points 6 or 7, characterised in that the actuation element is a lever which is mobile in rotation around a second rotational shaft, the rotation of the lever from the first position to the second position giving rise to loading then relaxation of the torsion spring.

9. Locking and unlocking device according to points 7 and 8, characterised in that it includes a support which can be secured integrally to an upper cuff, the first rotational shaft and the second rotational shaft being secured on the support.

10. Locking and unlocking device according to one of points 6 to 9, characterised in that the torsion spring is retained only by its first end which is connected to the rocker and by its second end which is connected to the lever.

11. Locking and unlocking device according to one of the preceding points, characterised in that it comprises a resilient control means which can control a displacement of the rear deflector downwards or upwards relative to an upper cuff.

12. Locking and unlocking device according to the preceding point, characterised in that the resilient control means comprises a runner which can slide vertically relative to the rear deflector and a resilient means, in particular a spring, the resilient means comprising two ends, each end of the resilient means being able to be supported either on the runner or on the rear deflector, such that the resilient means, is always thrust in compression when the rear deflector is displaced downwards relative to the runner, or when the rear deflector is displaced upwards relative to the runner.

13. Locking and unlocking device according to one of the preceding points, characterised in that the rear deflector has a curved form which is designed to envelop the rear of a leg, and/or a form of a "V" or "U", and/or includes shoulders on its lateral ends which can co-operate with the wall of a shell base delimiting a cut-out.

14. Locking and unlocking device according to point 9, characterised in that the said support includes at least one groove which can guide the rear deflector according to a slide connection.

15. Sports boot including a shell base, an upper cuff which is articulated in rotation around the shell base, characterised in that it includes a locking and unlocking device according to one of the preceding points.

16. Sports boot according to the preceding point, characterised in that the shell base includes a cut-out in an upper rear part, the cut-out being closed by the rear deflector in the low position, and the cut-out being at least partly opened up when the rear deflector is in the high position.

These objectives, characteristics and advantages of the present invention will be described in detail in the following description of a particular embodiment provided by way of non-limiting example in relation with the appended figures, in which.

In all of the figures and in the description, account is taken of a boot supported by means of its sole on a horizontal ground. The axis X designates the longitudinal axis. In progression towards the front, and in the straight line, a user of the boot progresses from the rear forwards according to a direction parallel to the longitudinal axis X. The axis X is oriented from the rear towards the front. The axis Y designates the transverse axis of the user. The axis Y is oriented from the left towards the right according to the viewpoint of the user. The axis Z designates the axis perpendicular to the axis X and to the axis Y. The axis Z is a vertical axis when the user is on a horizontal ground. The axis Z is oriented from bottom to top. The axes X, Y and Z form an orthogonal point of reference.

Figure 1:
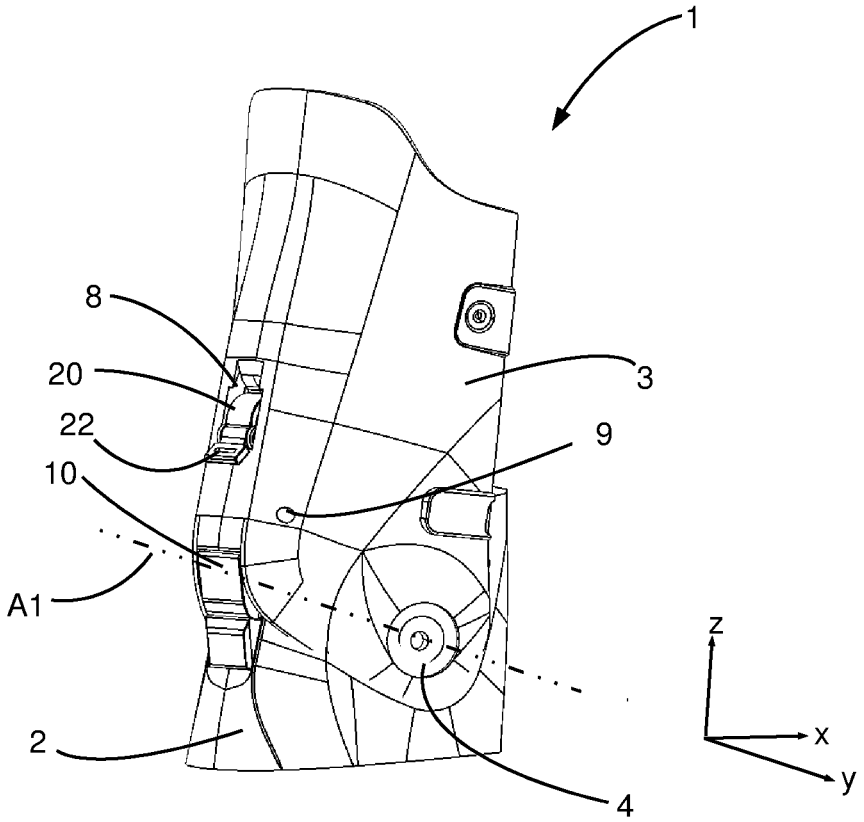
FIG. 1 is a partial isometric view of a ski boot in the "ski" configuration according to an embodiment of the invention.

FIG. 1 illustrates partly a sports boot 1 according to an embodiment of the invention. In particular, the sports boot is a ski boot which is designed in particular for the practice of downhill skiing, cross-country skiing, Telemark skiing, or also the practice of snowboarding. As a variant, the invention which will be described could be used for any type of sports boot comprising an articulation and a detachable means for blocking of this articulation.

The ski boot 1 comprises a shell base 2 which can envelop the foot below the ankle, and an upper cuff 3 which can envelop the bottom of the leg above the ankle. The ski boot can also comprise a comfort liner (not represented) interposed between the shell base and the foot of the user and between the upper cuff and the foot of the user, as well as means (not represented) for tightening the upper cuff around the bottom of the leg and/or the shell base around the foot. The shell base and the upper cuff are each made of a wall, advantageously obtained by injection of plastic. The ski boot 1 comprises an articulation in rotation 4 between the shell base 2 and the upper cuff 3. In particular, the articulation in rotation 4 can be produced by means of bearings provided in the shell base 2 and in the upper cuff 3. These bearings are thus positioned at the height of the medial malleolus and the lateral malleolus and co-operate with shafts (not represented), such as screws or rivets. The axis A1 designates the axis of rotation of the upper cuff around the shell base. The axis A1 is substantially parallel to the transverse axis Y.

Figure 2:
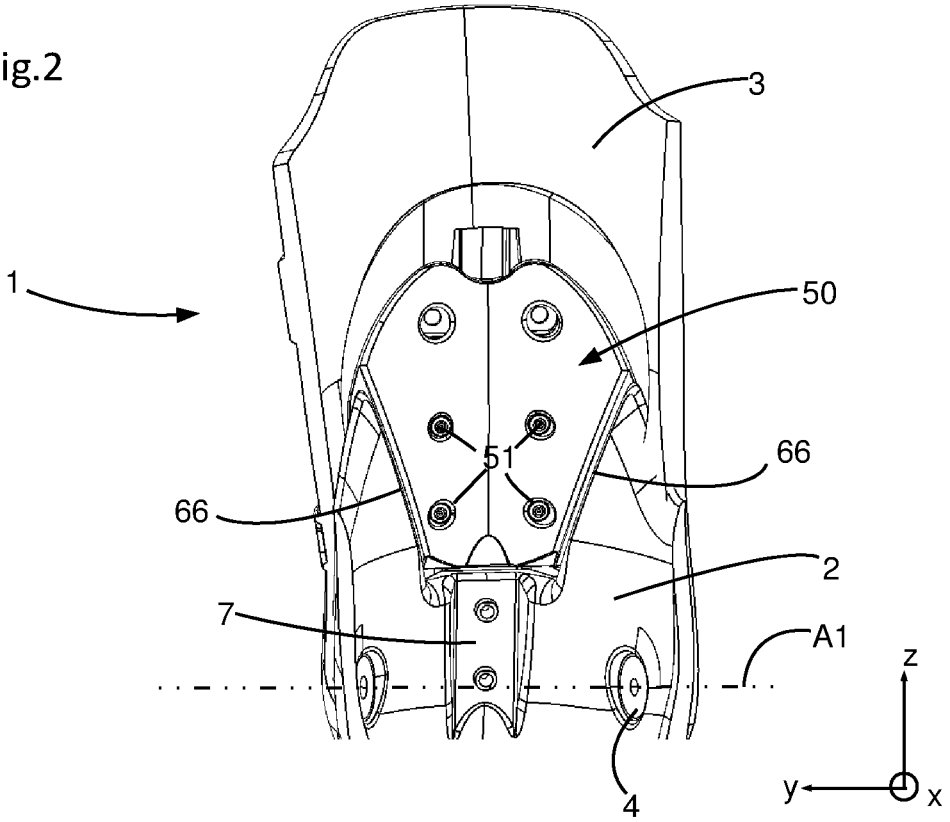
FIG. 2 is an isometric view of the interior of the ski boot in the "ski" configuration.
Figure 3:
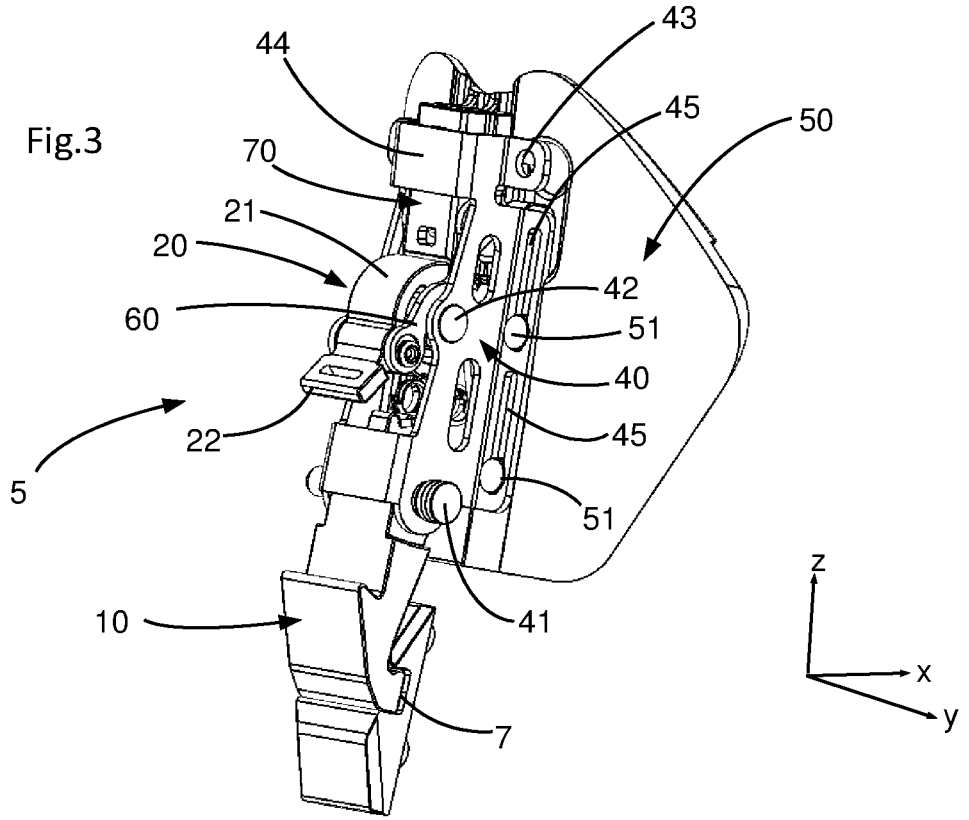
FIG. 3 is an isometric view of a locking and unlocking device in the "ski" configuration according to an embodiment of the invention.
Figure 6:
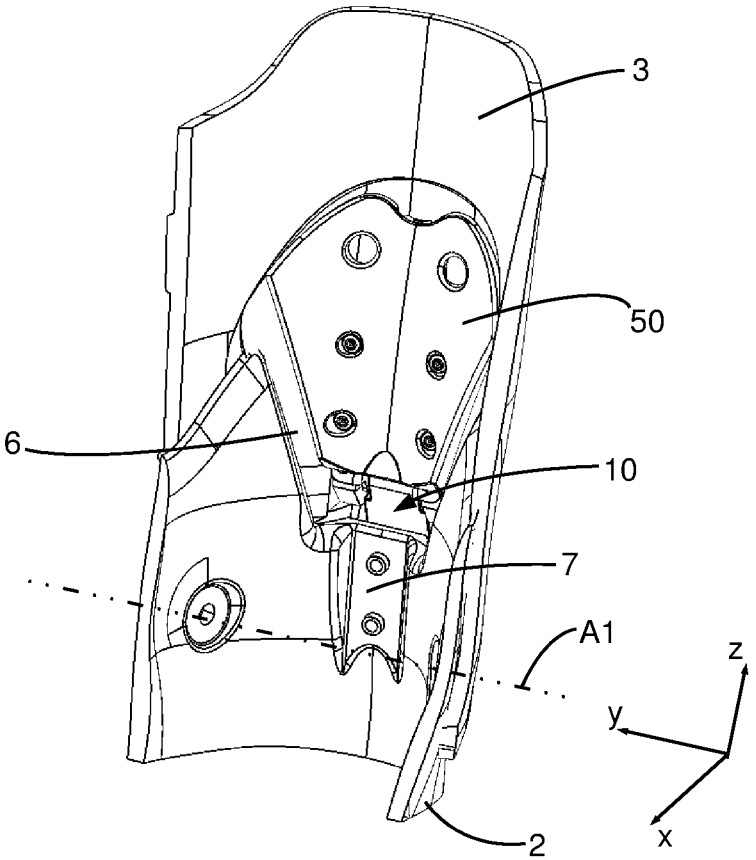
FIG. 6 is an isometric view of the interior of the ski boot in the "walk" configuration.
Figure 7:
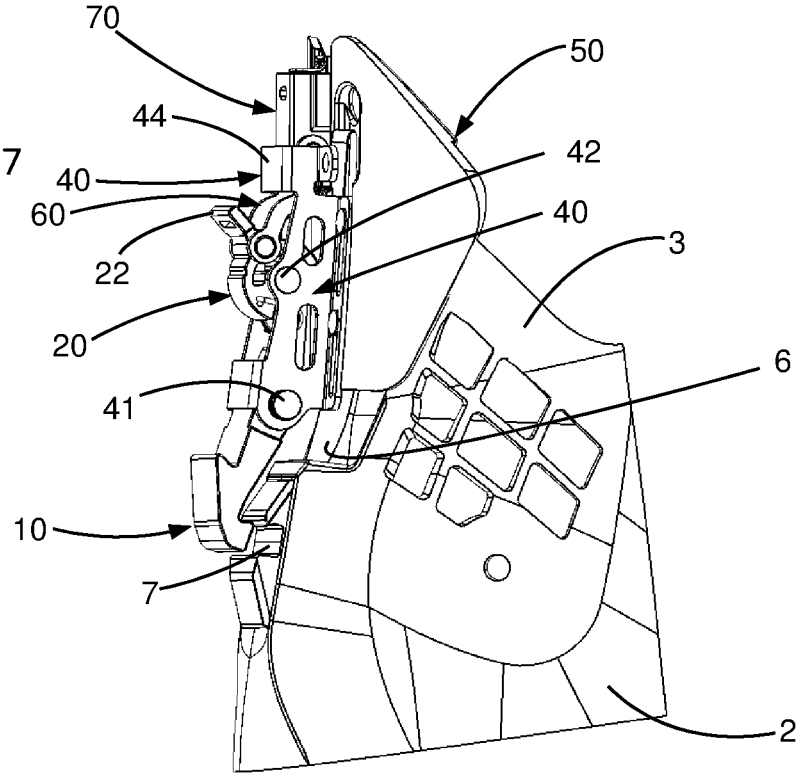
FIG. 7 is an isometric view of the locking and unlocking device in the "walk" configuration, and of a shell base of the ski boot.
Figure 12:
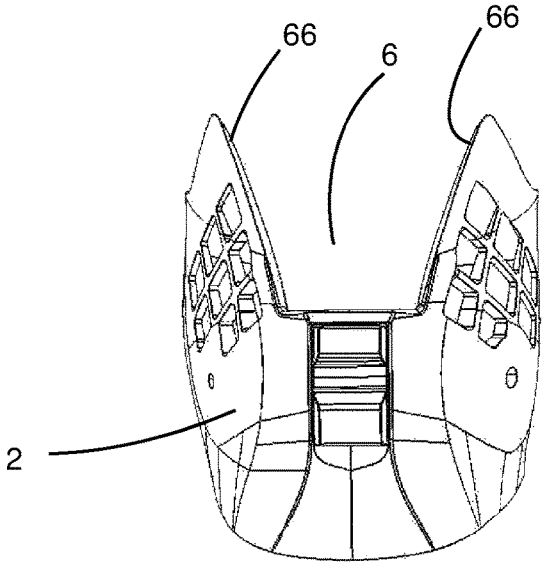
FIG. 12 illustrates a rear view of a part of a shell base of a sports boot according to an embodiment of the invention.

The ski boot 1 comprises a locking and unlocking device 5, which is represented in particular in FIG. 3, according to an embodiment of the invention. The locking and unlocking device 5 forms an interface between the shell base 2 and the upper cuff 3. It makes it possible to block or release the articulation in rotation 4 between the shell base 2 and the upper cuff 3. The locking and unlocking device 5 is positioned at the rear of the ski boot, and is placed in a cut-out 6 in the shell base 2. The cut-out 6 is an opening which is provided at the rear and in the upper part of the shell base. It can have a form of a "V" or a form of a "U", and can be seen in particular in FIGS. 2, 6 and 12.

The locking and unlocking device 5 is secured on the upper cuff 3 and co-operates with the shell base 2 in order to block or release the articulation in rotation. The ski boot can thus be in two distinct configurations. In a first configuration known as the "ski" configuration, the articulation in rotation between the shell base 2 and the upper cuff 3 is blocked, and the transmission of the forces from the foot to the boot and to the ski is optimal. When the user has a foot inside the boot in the ski configuration, the articulation of his ankle is thus blocked. It can be noted that a low amplitude in the articulation of the ankle may persist because of the rigidity of the materials used for the production of the ski boot. In a second configuration, known as the "walk" configuration, the articulation in rotation between the shell base 2 and the upper cuff 3 is released, i.e. it is free, or in other words not blocked. When the user has a foot inside the boot in the walk configuration, he can move the articulation of his ankle, which allows him to walk with the ski boots or to progress on the snow with the skis worn, in particular in the practice of cross-country skiing. It can be noted that the amplitude of movement of the ankle can nevertheless be limited by front and rear stops of the ski boot, in particular between the shell base and the upper cuff. Thus, the amplitude of movement of the ankle inside the boot in the walk configuration can be less than the amplitude of natural movement of the ankle. It is nevertheless greater than the amplitude of movement of the ankle inside the boot in the ski configuration. The ski boot 1 and its locking and unlocking device 5 in the ski configuration are illustrated in FIGS. 1 to 4. The ski boot 1 and its locking and unlocking device 5 in the walk configuration are illustrated in FIGS. 5 to 8.

With reference to FIGS. 3 and 4, 7 and 8, the locking and unlocking device 5 comprises:

- a rocker 10;
- a lever 20;
- a torsion spring 30;
- a support 40;
- a rear deflector 50;
- two connection arms 60; and
- a resilient control means 70.

Figure 4:
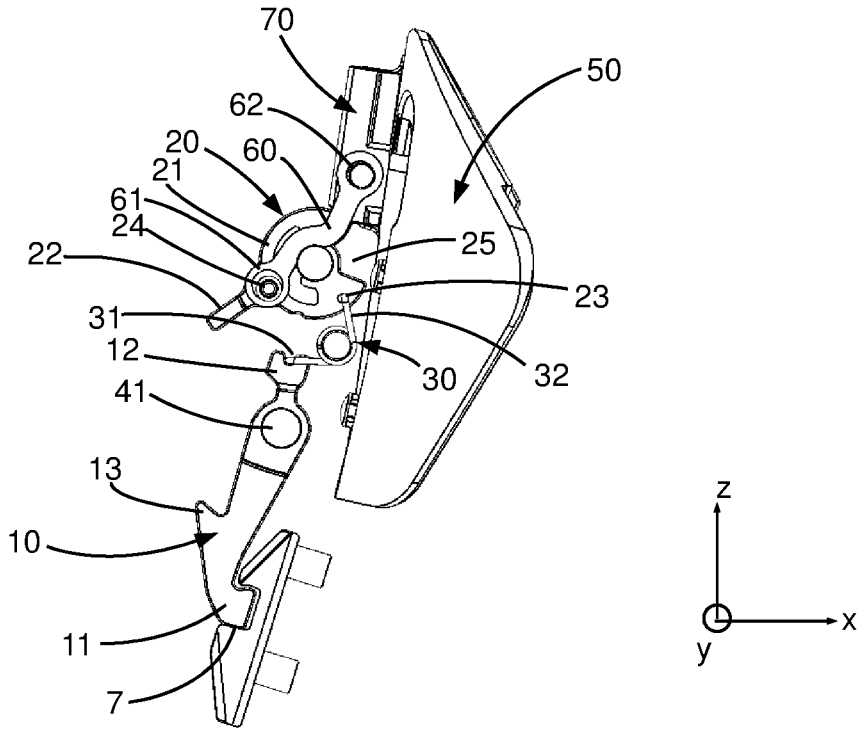
FIG. 4 is a profile view of the locking and unlocking device in the "ski" configuration.
Figure 5:
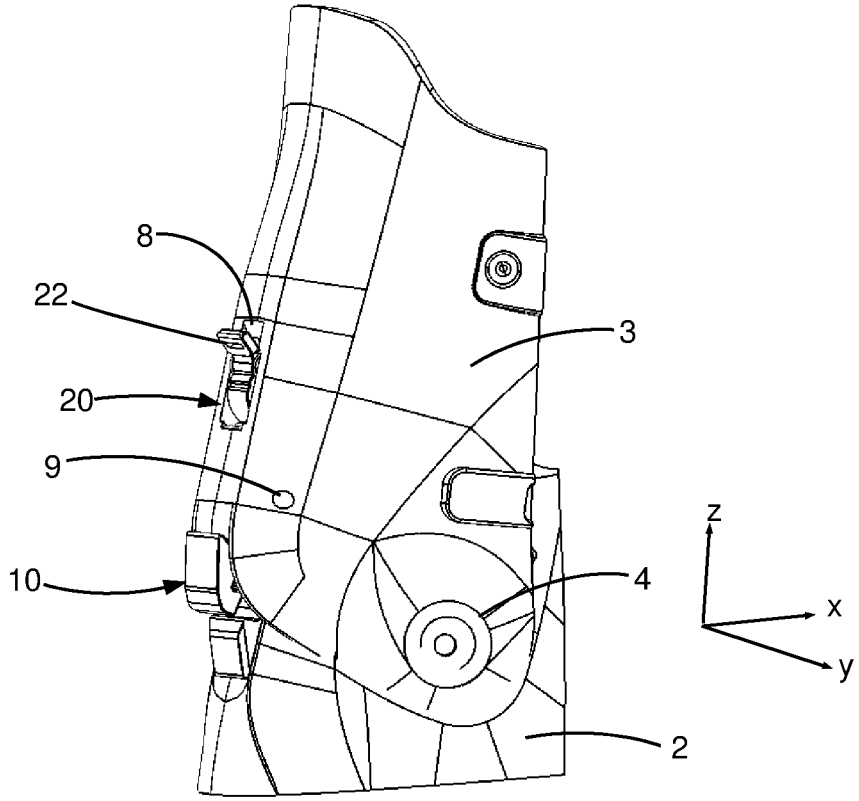
FIG. 5 is a partial isometric view of the ski boot in the "walk" configuration.
Figure 8:
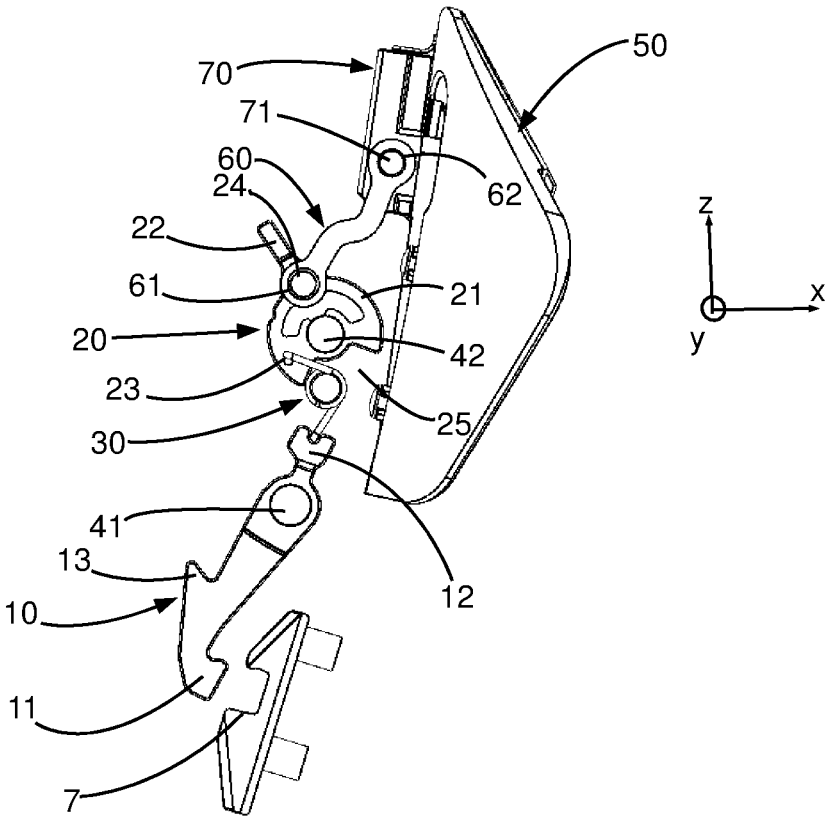
FIG. 8 is a profile view of the locking and unlocking device in the "walk" configuration.

It can be noted that the support 40 is not represented in FIG. 4 and in FIG. 8, such as to show clearly the other components of the locking and unlocking device 5.

The rocker 10 comprises a first end oriented downwards, and a second end oriented upwards. The first, low end is equipped with a hooking means 11 which can co-operate with the shell base when the rocker 10 is in the locking position. More specifically, at the rear and in the middle, the shell base comprises a groove 7 which is oriented transversely. This groove can form an assembly in a single piece with the shell base 2, or it can be an element secured on the shell base. According to the embodiment illustrated, the groove 7 is an added-on element which is secured on the shell base by means of two inserts which co-operate with two holes with a corresponding form in the shell base 2. The hooking means 11 is constituted by a protuberance which extends substantially along the longitudinal axis. When the ski boot is in the ski configuration, the protuberance is placed in the groove 7. The abutment of the protuberance on an upper edge of the groove prevents the upper cuff from pivoting forwards. The abutment of the protuberance on a lower edge of the groove prevents the upper cuff from pivoting rearwards. Consequently, when the protuberance is in place inside the groove, the articulation between the shell base and the upper cuff of the ski boot is blocked. As a variant, it would be possible to envisage any other form for the co-operation between the rocker and the shell base. For example, the hooking means 11 could be a recess or a groove which co-operates with a protuberance of the shell base, thus preventing the movements of the upper cuff relative to the shell base.

The second, high-end of the rocker 10 is equipped with a first means 12 for connection to the torsion spring. More specifically, the first connection means 12 is formed by a groove which extends transversely. This groove is substantially oriented upwards and receives a first end 31 of the torsion spring 30. Advantageously, the torsion spring 30 is always more or less constrained, irrespective of the configuration of the ski boot. Thus, the first end 31 of the torsion spring remains in place in the groove without risk of escaping from it. As a variant, the first end 31 of the spring could be secured on the rocker via a recess provided for this purpose at the end of the rocker. Also as a variant, the means 12 for connection of the rocker to the torsion spring could be designed such that a larger part of the spring than its end 31 alone co-operates with the rocker 10.

The rocker 10 is mobile between a locking position in which it blocks the upper cuff 3 in rotation relative to the shell base 2, and an unlocking position in which it releases the rotation of the upper cuff 3 relative to the shell base 2. The locking position is illustrated in particular in FIG. 4, and the unlocking position is illustrated in particular in FIG. 8. In the unlocking position, the means 11 for hooking of the rocker 10 is released from the groove 6 in the shell base, and is thus no longer in contact with the shell base. The rocker is mobile in rotation between its locking position and its unlocking position, around a first rotational shaft 41, positioned between the first end and the second end. The first rotational shaft 41 is integral with the support 40, and extends parallel to the transverse axis Y. The first shaft 41 is fitted such as to rotate on the support 40, which itself is secured on the upper cuff. The first shaft 41 is thus also fitted such as to rotate relative to the upper cuff. As can be seen in particular in FIG. 4, the first shaft 41 is closer to the second, high end, than to the first, low end. Thus, by lever effect, a slight displacement of the second end can give rise to a greater displacement of the first end.

In addition, the rocker 10 also comprises a protuberance, for example in the form of a tooth or an outer rim 13, which acts as a support for a lower rim of the upper cuff 3. The outer rim forms a projection which extends longitudinally rearwards, and comprises a length of the order of greatness of the thickness of the wall which forms the upper cuff.

The lever 20 is a part, preferably in a single piece, comprising a wheel 21 and a handle 22. The handle 22 constitutes a means for manual actuation of the device 5 for the user. Lever 20 is mobile in rotation around a second rotational shaft 42, between a first position and a second position. The second rotational shaft 42 is integral with the support 40, and extends parallel to the transverse axis Y. The second shaft 42 is fitted such as to rotate on the support 40, which itself is secured on the upper cuff. The second shaft 42 is thus also fitted such as to rotate relative to the upper cuff. The second shaft 42 also extends parallel to the first rotational shaft 41 of the rocker 10. The first shaft 41 and the second shaft 42 are thus positioned at a fixed distance relative to one another. The wheel 21 has globally the form of a cylinder, and the second rotational shaft 42 passes via the axis of revolution of this cylinder. The wheel 21 comprises a second connection means 23 which co-operates with a second end 32 of the torsion spring. This second connection means 23 is eccentric relative to the axis of rotation of the wheel 21. According to the embodiment presented, this means is constituted by a hole which is oriented transversely, and co-operates with the second end 32 of the spring 30. Finally, the wheel 21 also comprises a third connection means 24, which co-operates with two connection arms 60. The third connection means 24 is formed by a shaft which is oriented transversely, and projects from the two sides of the wheel 21. The shaft is eccentric relative to the centre of the wheel 21, and is positioned substantially at the base of the handle 22. The two connection arms 60 each comprise a circular hole 61 which co-operates with this shaft. As a variant, the two connection arms 60 could each comprise two protuberances or pins in order to co-operate with a recess/bore provided in the wheel 21. The connection arms 60 thus form a means for connection between the lever 20 and the deflector 50, the operation of which will be described hereinafter. It can be noted that the wheel 21 can comprise locally a recess 25 which makes it possible in particular to avoid any interference of contact with the rear deflector during the rotation of the wheel 21, whilst lightening the wheel.

The handle 22 projects rearwards from the ski boot. When the ski boot is in the ski configuration, the lever 20 is in the first position, and the handle 22 extends globally rearwards and downwards. When the ski boot is in the walk configuration, the lever 20 is in the second position, and the handle 22 extends globally rearwards and upwards. Between the first position and the second position, the lever 20 can perform a rotation of approximately a quarter of a turn. Advantageously, the collar comprises an opening 8 at the rear, facing the lever 20, such that the handle is easily accessible. The handle can be actuated directly by hand or via the tip of a ski pole. For this purpose, the handle advantageously comprises an opening which makes it possible to block the tip of the ski pole. In a variant, the opening can permit the passage of a strap, for example made of textile, which facilitates the gripping of the lever by the user in order to actuate the device.

The torsion spring 30, which could also be known as a "kickover spring", comprises a series of coils 33 between the two ends 31, 32. The torsion spring 30 is means with resilient torsion. It is designed to be thrust according to a rotational torque parallel to the axis of the coils. The coils are contained in an envelope in the form of a cylinder, the axis of revolution of which is oriented transversely. Thus, the torsion spring can be thrust according to a rotational torque around an axis parallel to the transverse axis Y.

Figure 9:
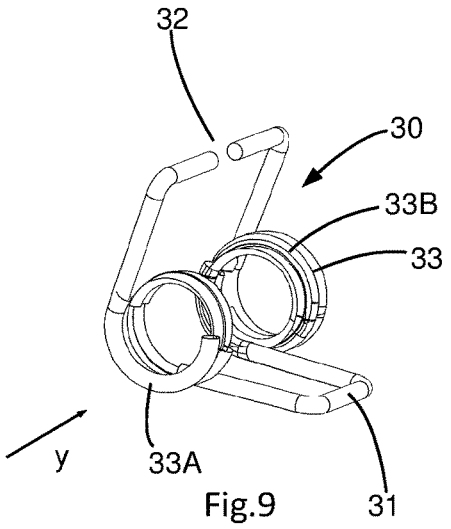
FIG. 9 is an isometric view of a torsion spring of the locking and unlocking device.

FIG. 9 illustrates in greater detail the design of the spring. The set of coils 33 is broken down into two groups of coils 33A, 33B which are disposed transversely on both sides of the first end 31. The torsion spring is made from a single steel wire. The two ends of the steel wire are positioned at the second end 32 of the torsion spring, whereas the first end 31 of the torsion spring is formed by a median part of the steel wire, extending substantially transversely. According to a view on the longitudinal and vertical plane, the two ends 31, 32 of the torsion spring are arranged according to a form of a "V", with the set of coils 33 positioned at the tip of the "V". The torsion spring can be thrust by drawing together the two branches of the "V", i.e. by bringing the two ends 31, 32 towards one another. Advantageously, the free part with a small size between the two ends of the steel wire at the second end is positioned on the same longitudinal and vertical plane as the middle of the first end 31. Thus, when a force is exerted on the longitudinal and vertical plane in order to bring the two ends 31, 32 of the torsion spring towards one another, the coils are loaded only in the direction of the winding, which prevents any relaxation or creeping of the torsion spring 30.

The rocker 10, the lever 20 and the torsion spring 30 are designed such that, when the lever is in its first position, the rocker is in the locking position, and, when the lever is in its second position, the rocker is in the unlocking position. The locking position and the unlocking position of the rocker are kept stable under the effect of the spring 30, i.e. the torsion spring tends to retain the rocker in the position in which it is located. In fact, when the lever goes from the first position to the second position, the second connection means 23 to which the second end 32 of the torsion spring 30 is secured describes a circular movement. According to this circular movement, the second end 32 of the torsion spring approaches the first end 31 progressively, then reaches a maximal extent of approach, then moves away from the first end 31. Consequently, the rotation of the lever from the first position to the second position gives rise to loading of the torsion spring by torsion in the direction of winding of the coils, then to relaxation of the torsion spring. The same phenomenon of loading followed by relaxation occurs when the lever goes from the second position to the first position. Thus, the locking position and the unlocking position of the rocker are positions of the rocker in which the torsion spring accumulates the least energy, and these positions are thus stable positions.

The displacement of the rocker is driven by displacement of the lever, by means of the torsion spring. The force which is applied by the user on the lever is transmitted to the rocker by means of the torsion spring. There is therefore no direct contact between the rocker and the lever, or a rigid part interposed between the lever and the rocker transmitting to the rocker the force applied by the user on the lever. The spring 30 is retained only by its first end 31 which is connected to the rocker and by its second end 32 which is connected to the lever. The ends 32 of the spring are positioned in recesses or holes provided in the rocker. The torsion spring is not in contact with other elements of the ski boot. Finally the torsion spring 30 is used both to stabilise the locking and unlocking positions of the rocker, and to transmit a force on the lever to the rocker.

The support 40 is an element of the locking and unlocking device 5 which is secured integrally on the upper cuff 3 and supports different elements of the locking and unlocking device 5. The support 40 is interposed between the collar, which is behind it, and the rear deflector 50 which is in front, along the longitudinal axis. The locking and unlocking device 5 is thus protected from the exterior by the upper cuff 3, and on the interior of the boot by the rear deflector 50. The support 40 is secured on the upper cuff 3, firstly via two circular holes 43 at the top of the support, through which there can pass two screws or two rivets engaged with the upper cuff. Secondly, the support is secured on the upper cuff by means of the first shaft 41. In fact, the first shaft 41 acts not only as a rotational shaft for the rocker 10, but also co-operates with two openings 9 provided in the upper cuff 3, as can be seen in particular in FIGS. 1 and 5. The first rotational shaft 41 is secured on the support 40 at a lower end of the support. The second rotational shaft 42 is secured on the support 40 at approximately halfway up the support 40. In addition, at its upper end, the support 40 comprises a bridge 44 in the form of a "U", below which the resilient control means 70 can slide. Finally, the support also comprises four oblong openings 45 extending substantially vertically. These oblong openings 45 co-operate with studs 51 of the rear deflector 50, in order to define a slide connection which is oriented vertically between the support 40 and the rear deflector 50.

Figure 13:
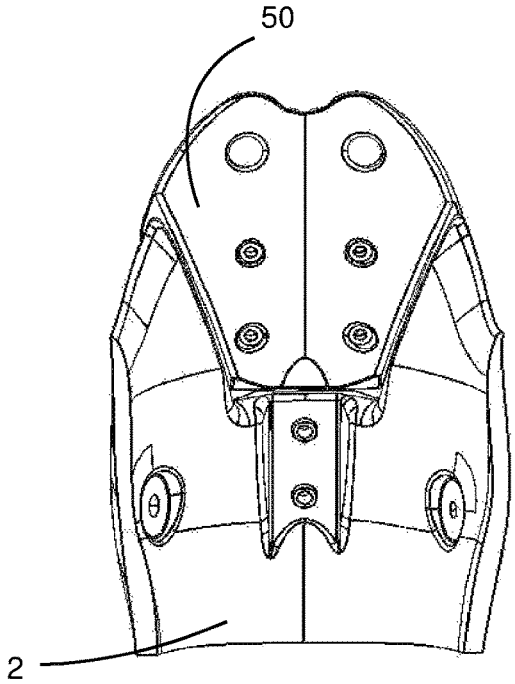
FIG. 13 illustrates a view from the front of a part of a shell base of a sports boot, the cut-out of which is closed by a rear deflector according to an embodiment of the invention.
Figure 14:
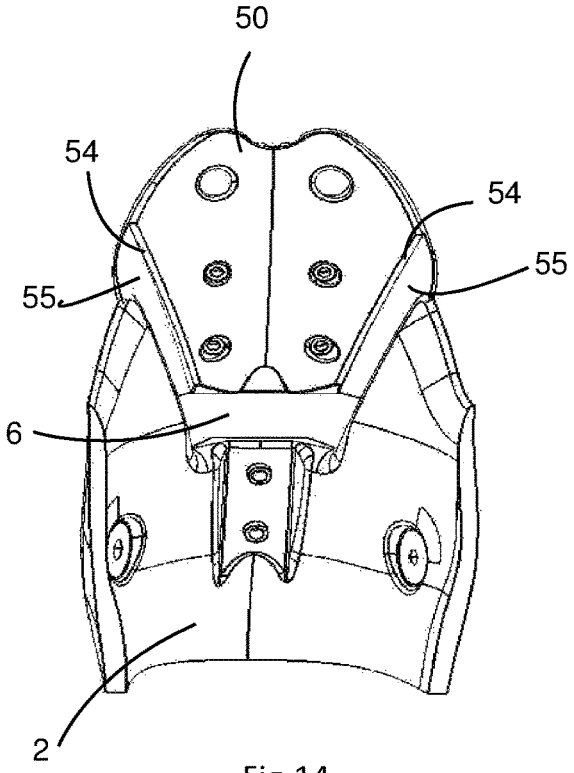
FIG. 14 illustrates a view from the front of a part of a shell base of a sports boot, the cut-out of which is partly released by the rear deflector according to the embodiment of the invention.

The rear deflector 50, which could also be known as a spoiler, is an element which can envelop the rear of the bottom of the leg, i.e. the bottom of the ankle. The rear deflector can be positioned in the cut-out 6 provided at the rear of the shell base 2, as represented in particular by FIGS. 12 to 14. The rear deflector comprises a curved form in order to match the natural form of the ankle. The rear deflector 50 is fitted such as to slide vertically relative to the support 40, and thus indirectly relative to the upper cuff 3. For this purpose, the four studs 51, which are secured on a rear face of the rear deflector, co-operate with the four oblong openings 45 in the support 40. The rear deflector 50 is mobile between a low position and a high position. In the low position, or ski position, the rear deflector closes, in other words stops up or fills, the cut-out 6 at the rear of the shell base 2, as represented by FIG. 13. In the low position, the rear deflector extends the natural curvature of the shell base 2. In the high position, or walk position, the rear deflector 50 opens up the cut-out 6 or reveals it at least partly, as represented by FIG. 14.

This displacement of the rear deflector 50 will now be described. The two connection arms 60 connect the rear deflector to the lever, such that the first position of the lever retains the rear deflector in its low position, and the second position of the lever retains the rear deflector in its high position. The two connection arm 60 extend from the wheel 21 as far as the resilient control means 70, which itself is connected to the rear deflector 50. The two connection 60 are substantially identical, and are arranged vertically on both sides of the wheel 21. Each arm comprises two circular holes 61, 62 at each of its two ends. The first circular hole 61 co-operates with the third connection means 24 of the wheel 21. The second circular hole 62 co-operates with a fourth connection means 71, which can be seen in particular in FIG. 8, and is integral with the resilient control means 70. The fourth connection means 71 is formed by two stubs extending transversely on both sides of the resilient control means 70. It can be noted that the connection arms have a curved form which makes it possible to follow the contours of the second rotational shaft 42. Thus, the two connection arms 60 do not come into contact with the second rotational shaft 42, irrespective of the position of the lever 20.

When the lever 20 is displaced from its first position to its second position, the third connection means 24 is displaced upwards. The two connection arm 60 are also displaced upwards. The resilient control means 70 and the rear deflector 50 are then translated upwards according to the slide connection imposed by the co-operation of the studs 51 with the oblong openings 45. The rear deflector then releases at least partly the cut-out 6 which is provided at the rear of the shell base 2, as represented in FIG. 14. Conversely, when the lever is displaced from its second position to its first position, the rear deflector descends and fills up the cut-out in the shell base, as represented in FIG. 13, i.e. the edges of the rear deflector 50 match the edges 66 of the cut-out 6, thus completing the wall of the shell base in order to form an assembly which is substantially equivalent to a continuous shell base, without a cut-out.

According to an advantageous embodiment, the rear deflector 50 additionally comprises two lateral surfaces 55 which are designed to be supported on the rear surface of the shell base, then a central part in relief which is designed to occupy the free space of the cut-out 6. This part in relief forms two lateral surfaces in relief 54 which are designed to be supported against the surfaces disposed in the thickness of the lateral walls of the cut-out, at the edges 66 of this cut-out. These lateral surfaces in relief 54 are oriented in a direction which is substantially perpendicular to the lateral surfaces 55, these two surfaces together thus forming a shoulder. This shoulder guarantees the good positioning and good retention of the rear deflector relative to the shell base in the two, longitudinal X and transverse Y directions in the position for the practice of skiing. This construction of the connection by means of a double stop of the shoulder type between the spoiler and the shell base allows the shell base to have globally rigidity similar to that of the shell bases of the prior art, without a cut-out. It can be noted that the lateral surfaces 55 form fins which cover the rear surface of the shell base, thus participating in the function of a stop and co-operation of the rear deflector and the shell base.

As a variant, the rear deflector could have another form, in particular at its support surfaces forming a stop of the shoulder type on the shell. In fact, any other configuration making it possible to obtain a stop in the two, longitudinal X and transverse Y directions could be suitable, including by means of a single inclined support surface. Also as a variant, the shoulder described could have another form. According to a simplified variant, the stop of the rear deflector could exist only in the longitudinal direction, in order to guarantee that the rear deflector does not pass through the cut-out 6 towards the interior of the shell base, where it would be liable to strike the leg of the skier.

When the rear deflector 50 is in the high position, the co-operation between the rear deflector and the shell base is totally modified. In particular, the rear deflector no longer completes the missing portion of the shell base at the cut-out. On the contrary, a pressure forwards exerted by the rear deflector on the shell base deforms the lateral high parts of the shell base delimiting the cut-out, thus permitting an advance of the rear deflector. Thus, when the bottom of the leg of a user exerts flexure forwards, a pressure is offset to the rear deflector by means of the upper cuff, thus inducing deformation of the shell base, in particular of the walls or edges 66 which border the cut-out 6. This results in amplified clearance forwards of the bottom of the leg, and in facilitated walking.

The resilient control means 70 is an element of the intermediate locking and unlocking device 5 between the two connection arms 60 and the rear deflector 50. It has a substantially parallelepiped form, and can slide below the bridge 45 of the support 40. It can deaden displacement of the rear deflector downwards or upwards relative to the upper cuff 3. The rear deflector is mobile relative to the resilient control means 70, upwards and downwards from an intermediate position.

Figure 10:
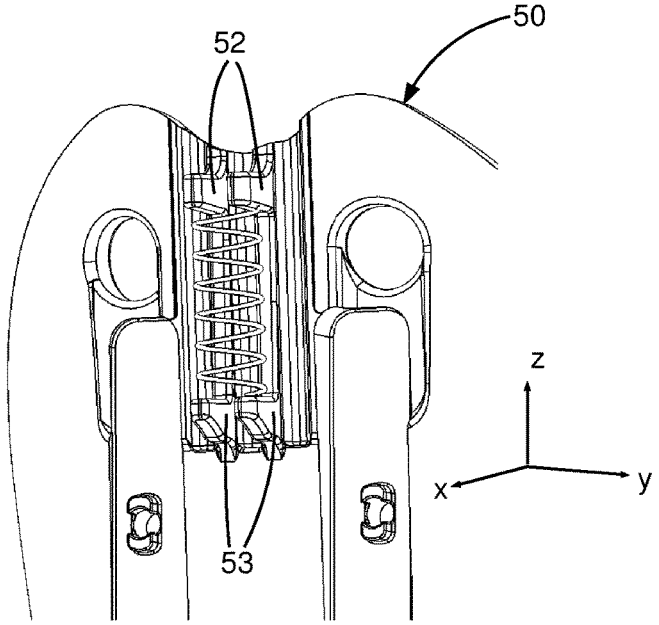
FIG. 10 illustrates partly a rear deflector of the locking and unlocking device.
Figure 11:
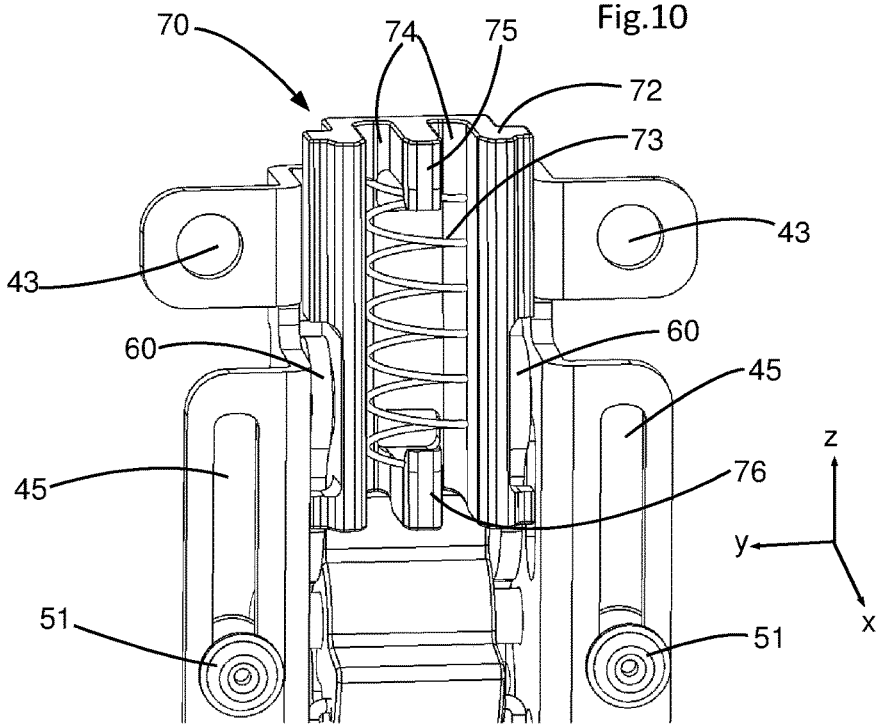
FIG. 11 illustrates partly a support and a runner of the locking and unlocking device.

The resilient control means 70 is represented in particular in FIGS. 10 and 11. It comprises a runner 72 which can slide vertically relative to the rear deflector and a resilient means 73, in particular a spring. The runner 72 comprises two grooves 74 which are oriented vertically. These grooves 74 co-operate with two upper projections 52 and two lower projections 53 which are present at the back of the rear deflector 50. Between the two grooves 74, the runner 72 comprises a high stop 75 and a low stop 76. The resilient means 73 is accommodated in the interior of the runner 72. In the absence of any constraint on the rear deflector 50, an upper end of the resilient means 73 is supported on the high stop 75 and on the upper projections 52, and a lower end of the resilient means 73 is supported on the low stop 76 and on the lower projections 53. In this position of the rear deflector, the resilient means can already be partly compressed in order to prevent it from moving. When a constraint oriented upwards is exerted on the rear deflector 50, the deflector is displaced upwards relative to the runner. The projections 52, 53 slide in the grooves 74. The upper end of the resilient means 73 is supported only on the high stop 75, and the lower end of the resilient means 73 is supported only on the lower projections 53. When a constraint oriented downwards is exerted on the rear deflector 50, the deflector is displaced downwards relative to the runner. The projections 52, 53 slide in the grooves 74. The upper end of the resilient means 73 is supported only on the upper projections 52, and the lower end of the resilient means 73 is supported only on the low stop 76. Thus, the resilient means is always thrust in compression when the rear deflector 50 is displaced downwards relative to the runner 72, or when the rear deflector is displaced upwards relative to the runner. This therefore provides a means for resilient control of the rear deflector according to vertical movements. This resilient control means makes it possible to increase the comfort of the user by providing a stop which is flexible for his ankle. In addition, since the spring is always thrust in compression, it is more durable, since a spring withstands the compression constraints better than the extension constraints. Advantageously, the high and low stop 75, 76 each comprise a means for retention of the resilient means (in this case a nose which is supported longitudinally on each end of the resilient means 73), such as to retain the resilient means in place in the interior of the runner. The rear deflector 50 is suspended relative to the upper cuff 3. The vertical displacement of the rear deflector which is obtained by means of the suspension means 70 is added to the vertical displacement of the rear deflector obtained by means of the lever 20 and the connection arms 60. It can be noted that the cut-out 6 and the rear deflector can have dimensions such that the rear deflector can be displaced downwards via the suspension means 70, even when the ski boot is in the ski configuration. Thus, the comfort of the user is increased both in the ski configuration and in the walk configuration.

Finally, thanks to the invention, a ski boot is obtained equipped with a locking and unlocking device which is at the same time reliable, stable, light, compact and simple to manipulate. In addition, the combination of an element for locking/unlocking of the upper cuff and a synchronised rear deflector makes it possible to increase the amplitude of the articulation between the upper cuff and the shell base of the boot in the walking phase, thus improving the comfort of the boot, as previously explained.

It will be appreciated that the invention is not limited to the embodiment described. The cut-out in the shell base is positioned in the upper rear part, and has a surface area sufficient to obtain the effect required. For this purpose, the cut-out extends over at least a third of the height of the shell base in its rear part. In addition, it has a lateral opening which is sufficient to release the bottom of the leg. It will be appreciated that the rear deflector can comprise any form other than that of an aforementioned "V" or "U". The shell base can also adopt any complementary form, in particular its cut-out positioned at its upper end in the rear part.

The locking and unlocking device has been described with a lever. As a variant, any actuation element, which controls, preferably simultaneously, the displacements of a rear deflector and a rocker, could be used. Similarly, the device has been described with a rocker: the latter could have another form, forming a lock which can block the rotation of the upper cuff relative to the shell base. The spring which connects the lever to the rocker, and thus more generally the actuation element to the lock, could have a different form. It could be longilineal, with its coils being oriented in a direction perpendicular to the torsion spring represented. The spring could be any other spring. Advantageously, the rear deflector and the lock are distinct from one another. They are in the form of two distinct parts, not in the form of an assembly in a single piece. The locking and unlocking device thus comprises a first mechanical connection between the actuation element and the lock, and a second mechanical connection, distinct from the first mechanical connection, between the actuation element and the rear deflector.

As is apparent from the preceding description, the locking/unlocking device solves the technical problem of improvement of walking by means of a rear deflector 50 which is mobile facing a cut-out in a shell base of a sports boot.

It can be noted that a solution of this type also has an advantage apart from its association with a locking/unlocking device. In other words, a device comprising only a deflector and a mechanism which permits its mobility, preferably by means of translation or sliding, between at least two positions, also provides an advantageous solution to the technical problem of improvement of walking.

Thus, the invention also relates to a device, characterised in that it comprises a rear deflector which is mobile in translation between a low position and a high position, such as to co-operate with a cut-out in a shell base by closing this cut-out in the low position, and by releasing this cut-out at least partly in the high position.

This device can comprise any actuation means, i.e. the one previously described on the basis of the lever 20, or any other mechanism, in particular without the rocker previously described, and/or with a different spring, acting only on the lever.

Thus, the invention also relates to a device, characterised in that it comprises a rear deflector 50 which is designed to be fitted such as to slide vertically relative to an upper cuff 3, the rear deflector 50 being mobile between:

- a low position in which it closes a cut-out 6 at the rear of a shell base 2; and
- a high position in which it opens up at least partly a cut-out 6 at the rear of a shell base 2 in order to increase the amplitude of flexure of a foot in a sports boot 1;

the device comprising at least one connection arm 60 connecting the rear deflector 50 to a lever 20, such that the first position of the lever 20 retains the rear deflector 50 in its low position, and the second position of the lever 20 retains the rear deflector 50 in its high position.

The said device can comprise a resilient control means 70 which can damp a displacement of the rear deflector 50 downwards or upwards relative to an upper cuff 3.

The said resilient control means 70 can comprise a runner 72 which can slide vertically relative to the rear deflector 50, and a resilient means 73, in particular a spring, the resilient means 73 comprising two ends, each end of the resilient means being able to be supported either on the runner 72 or on the rear deflector 50, such that the resilient means 73 is always thrust in compression when the rear deflector 50 is displaced downwards relative to the runner 72, or when the rear deflector 50 is displaced upwards relative to the runner 72.

The device can comprise a support 40 on which there is fitted the means for actuation of the rear deflector, and comprising at least one groove 45 which can guide the rear deflector 50 according to a slide connection.

The rear deflector can have a curved form which is designed to envelop the rear of a leg.

The invention claimed is:

1. A locking and unlocking device for forming an interface between a shell base and an upper cuff of a sports boot and designed to be oriented along an axis that is perpendicular to a transverse axis (Y) of the sports boot, wherein the upper cuff is articulated in rotation around the shell base, the locking and unlocking device comprising:

an actuation element;

a lock; and a rear deflector, wherein the actuation element is mobile between a first position and a second position, controlling the position of the lock and the position of the rear deflector such that:

in the first position of the actuation element, the lock occupies a locking position in which the lock can block the upper cuff in rotation relative to the shell base, and the rear deflector occupies a low position in which the rear deflector can close a cut-out at a rear of the shell base;

in the second position of the actuation element, the lock occupies an unlocking position in which the lock can release the rotation of the upper cuff relative to the shell base, and the rear deflector occupies a high position in which the rear deflector can open up at least partly the cut-out at the rear of the shell base, in order to increase the amplitude of flexure of a lower leg of a user in the sports boot when worn; and wherein the lock is a rocker which is mobile between the first position of the actuation element in which the lock occupies the locking position and the second position of the actuation element in which the lock occupies the unlocking position, wherein in the locking position of the lock, the rocker can block the rotation of the upper cuff relative to the shell base; and wherein in the unlocking position of the lock, the rocker can release the rotation of the upper cuff relative to the shell base;

the actuation element comprises a lever which is mobile between a first lever position and a second lever position; and a spring including a first part connected to the rocker and a second part connected to the lever, the lever, the spring and the rocker are connected to one another such that the spring is retained only by the first part connected to the rocker and by the second part connected to the lever; and wherein the rocker, the lever and the spring are designed such that:

when the lever is in the first lever position, the rocker is in the locking position;

when the lever is in the second lever position, the rocker is in the unlocking position;

a position of locking and a position of unlocking of the rocker are maintained stable under an effect of the spring;

a displacement of the rocker is driven by a displacement of the lever by means of the spring, and wherein the spring comprises a set of coils arranged around an axis designed to be oriented parallel to the transverse axis (Y) of the sports boot.

2. The locking and unlocking device according to claim 1, wherein the rear deflector is distinct from the lock and can slide vertically relative to the upper cuff.

3. The locking and unlocking device according to claim 1, wherein the locking and unlocking device comprises at least one connection arm connecting the actuation element to the rear deflector.

4. The locking and unlocking device according to claim 1, wherein the rocker further comprises:

a first end equipped with a hooking means which can co-operate with the shell base when the rocker is in the locked position;

a second end equipped with a means for connection to the spring;

the rocker being mobile in rotation around a first rotational shaft positioned between the first end and the second end.

5. The locking and unlocking device according to claim 1, wherein the actuation element is driven by the lever which is mobile in rotation around a second rotational shaft, the rotation of the lever from the first lever position to the second lever position giving rise to loading then relaxation of the spring.

6. The locking and unlocking device according to claim 5, further comprising a support integrally secured to the upper cuff, a first rotational shaft and the second rotational shaft being secured on the support.

7. The locking and unlocking device according to claim 1, further comprising a resilient control means which can control a displacement of the rear deflector downwards or upwards relative to the upper cuff.

8. The locking and unlocking device according to claim 7, wherein the resilient control means comprises a runner which can slide vertically relative to the rear deflector and a resilient control means spring, the resilient control means spring includes two ends, each end of the resilient control means spring being able to be supported either on the runner or on the rear deflector, such that the resilient control means spring is always thrust in compression when the rear deflector is displaced downwards relative to the runner, or when the rear deflector is displaced upwards relative to the runner.

9. The locking and unlocking device according to claim 1, wherein the rear deflector has a curved form which is designed to envelop a rear of a user's leg, and/or a form of a "V" or "U", and/or comprises shoulders on lateral ends which can co-operate with a wall of the shell base delimiting the cut-out.

10. The locking and unlocking device according to claim 6, wherein the said support comprises at least one groove which can guide the rear deflector according to a slide connection.

11. A sports boot, comprising:

a shell base;

an upper cuff articulated in rotation around the shell base, the upper cuff includes a locking and unlocking device for forming an interface between the shell base and the upper cuff of the sports boot, wherein the upper cuff is articulated in rotation around the shell base, wherein the locking and unlocking device includes:

an actuation element;

a lock; and a rear deflector, wherein the actuation element is mobile between a first position and a second position, controlling the position of the lock and the position of the rear deflector such that:

in the first position of the actuation element, the lock occupies a locking position in which the lock can block the upper cuff in rotation relative to the shell base, and the rear deflector occupies a low position in which the rear deflector can close a cut-out at a rear of the shell base;

in the second position of the actuation element, the lock occupies an unlocking position in which the lock can release the rotation of the upper cuff relative to the shell base, and the rear deflector occupies a high position in which the rear deflector can open up at least partly the cut-out at the rear of the shell base, in order to increase the amplitude of flexure of a lower leg of a user in the sports boot when worn; and wherein the locking and unlocking device further comprises:

the lock is a rocker which is mobile between the first position of the actuation element in which the lock occupies the locking position and the second position of the actuation element in which the lock occupies the unlocking position, wherein in the locking position of the lock, the rocker can block the rotation of the upper cuff relative to the shell base; and wherein in the unlocking position of the lock, the rocker can release the rotation of the upper cuff relative to the shell base;

the actuation element is a lever which is mobile between a first lever position and a second lever position; and a spring including a first part connected to the rocker and a second part connected to the lever; and wherein the rocker, the lever and the spring are designed such that:

when the lever is in the first lever position, the rocker is in the locking position;

when the lever is in the second lever position, the rocker is in the unlocking position;

a position of locking and a position of unlocking of the rocker are maintained stable under an effect of the spring;

a displacement of the rocker is driven by a displacement of the lever by means of the spring, and the lever, the spring and the rocker are connected to one another along a vertical axis, the lever being in a top position on the sports boot along the vertical axis and the rocker being in a bottom position on the sports boot along the vertical axis, the vertical axis being oriented from bottom to top of the sports boot when the sports boot supported by means of its sole is on a horizontal ground, and the lever and the rocker are connected such that the spring is retained only by the first part connected to the rocker and by the second part connected to the lever.

12. The sports boot according to claim 11, wherein the shell base comprises the cut-out in an upper rear part, the cut-out being closed by the rear deflector in the low position, and the cut-out being at least partly opened up when the rear deflector is in the high position.

13. The locking and unlocking device according to claim 1, wherein the rear deflector is mobile vertically and can slide vertically relative to the upper cuff.

14. The locking and unlocking device according to claim 1, wherein the rear deflector has a form of a "V" or "U".

15. The locking and unlocking device according to claim 1, wherein the rear deflector has shoulders on lateral ends which can co-operate with a wall of the shell base delimiting the cut-out.

16. A locking and unlocking device for forming an interface between a shell base and an upper cuff of a sports boot and designed to be oriented along an axis that is perpendicular to a transverse axis (Y) of the sports boot, wherein the upper cuff is articulated in rotation around the shell base, the locking and unlocking device comprising:

an actuation element;

a lock; and a rear deflector, wherein the actuation element is mobile between a first position and a second position, controlling the position of the lock and the position of the rear deflector such that:

in the first position of the actuation element, the lock occupies a locking position in which the lock can block the upper cuff in rotation relative to the shell base, and the rear deflector occupies a low position in which the rear deflector can close a cut-out at a rear of the shell base;

in the second position of the actuation element, the lock occupies an unlocking position in which the lock can release the rotation of the upper cuff relative to the shell base, and the rear deflector occupies a high position in which the rear deflector can open up at least partly the cut-out at the rear of the shell base, in order to increase the amplitude of flexure of a lower leg of a user in the sports boot when worn; and wherein the lock is a rocker which is mobile between the first position of the actuation element in which the lock occupies the locking position and the second position of the actuation element in which the lock occupies the unlocking position, wherein in the locking position of the lock, the rocker can block the rotation of the upper cuff relative to the shell base; and wherein in the unlocking position of the lock, the rocker can release the rotation of the upper cuff relative to the shell base;

the actuation element comprises a lever which is mobile between a first lever position and a second lever position; and a spring including a first part directly connected to the rocker and a second part directly connected to the lever; and wherein the rocker, the lever and the spring are designed such that:

when the lever is in the first lever position, the rocker is in the locking position;

when the lever is in the second lever position, the rocker is in the unlocking position;

a position of locking and a position of unlocking of the rocker are maintained stable under an effect of the spring;

a displacement of the rocker is driven by a displacement of the lever by means of the spring, and wherein the spring comprises a set of coils arranged around an axis designed to be oriented parallel to the transverse axis (Y) of the sports boot.

17. A sports boot, comprising the locking and unlocking device according to claim 16, a shell base; and an upper cuff articulated in rotation around the shell base, wherein the upper cuff includes the locking and unlocking device for forming an interface between the shell base and an upper cuff of the sports boot.

* * * * *